US006325255B1

(12) United States Patent
Lane et al.

(10) Patent No.: US 6,325,255 B1
(45) Date of Patent: Dec. 4, 2001

(54) APPARATUS AND METHOD FOR VARIABLY RESTRICTING FLOW IN A PRESSURIZED DISPENSING SYSTEM

(75) Inventors: Michael L. Lane, Arvada, CO (US); James R. Gemmell, Toddington (GB)

(73) Assignee: Quoin Industrial, Inc., Golden, CO (US)

( * ) Notice: Subject to any disclaimer, the term of this patent is extended or adjusted under 35 U.S.C. 154(b) by 0 days.

(21) Appl. No.: 09/535,338

(22) Filed: Mar. 24, 2000

(51) Int. Cl.[7] ..... B65D 83/00

(52) U.S. Cl. ..... 222/396; 222/386.5; 222/395; 222/564; 138/46

(58) Field of Search ..... 222/173, 386.5, 222/395, 396, 506, 564; 130/42, 43, 46

(56) References Cited

U.S. PATENT DOCUMENTS

| | | | | |
|---|---|---|---|---|
| Re. 32,587 | | 2/1988 | Matsuura et al. | 128/685 |
| 2,762,397 | | 9/1956 | Miller | 138/43 |
| 2,777,464 | * | 3/1951 | Mosely | 137/516.13 |
| 3,552,444 | * | 1/1971 | Levesque | 138/43 |
| 3,831,600 | | 8/1974 | Yum et al. | 128/214 R |
| 4,120,425 | | 10/1978 | Bethurum | 222/146 C |
| 4,191,204 | | 3/1980 | Nehring | 137/205 |
| 4,210,172 | | 7/1980 | Fallon et al. | 137/504 |
| 4,702,397 | | 10/1987 | Gortz | 222/211 |
| 4,724,870 | | 2/1988 | Molbaek et al. | 138/46 |
| 4,785,972 | | 11/1988 | LeFevre | 222/1 |
| 4,867,348 | * | 9/1989 | Dorfman | 222/173 |
| 4,881,666 | | 11/1989 | Tullman et al. | 222/386.5 |
| 4,889,148 | | 12/1989 | Smazik | 137/1 |
| 4,919,310 | | 4/1990 | Young et al. | 222/386.5 |
| 4,923,095 | | 5/1990 | Dorfman et al. | 222/386.5 |
| 5,082,240 | | 1/1992 | Richmond | 251/120 |
| 5,190,075 | | 3/1993 | Tentler et al. | 137/501 |
| 5,333,763 | | 8/1994 | Lane et al. | 222/386.5 |
| 5,769,282 | | 6/1998 | Lane et al. | 222/386.5 |
| 5,884,667 | * | 3/1999 | North | 138/43 |

FOREIGN PATENT DOCUMENTS 1 049 176 1/1959 (DE) .

* cited by examiner

*Primary Examiner*—Kevin Shaver
*Assistant Examiner*—Melvin A. Cartagena
(74) *Attorney, Agent, or Firm*—Klaas, Law, O'Meara & Malkin, P.C.; Michael A. Goodwin, Esq.

(57) ABSTRACT

In a fluid flow restrictor, the amount of fluid flow restriction increases in response to higher dispensing system pressures and decreases in response to lower dispensing system pressures. In this manner, a relatively consistent flow rate of fluid being dispensed can be maintained regardless of fluctuations in system pressure. Variable resistance is provided by changing the length of the fluid flow path or by changing the cross-sectional area, and, thus, the volume of the fluid flow path, or by changing both the length and the cross-sectional area of the fluid flow path.

29 Claims, 11 Drawing Sheets

APPARATUS AND METHOD FOR VARIABLY RESTRICTING FLOW IN A PRESSURIZED DISPENSING SYSTEM

FIELD OF THE INVENTION

The present invention relates generally to a flow restrictor for use in dispensing pressurized fluids and, more particularly, to a flow restrictor which is capable of variable restriction in response to changing system pressure.

BACKGROUND OF THE INVENTION

Carbonated beverages, such as beer, contain carbon dioxide gas which is dissolved in solution. This dissolved carbon dioxide gas affects the flavor profile of the beverage and also causes the characteristic foaming or "outgassing" during dispensing of the beverage.

One type of carbonated beverage dispensing system, typically found, for example, in many bars and restaurants, generally includes a supply container (e.g., a keg) holding a quantity of the beverage. The supply container, in turn is generally attached to a dispensing faucet by a fluid conduit. A supply of pressurized carbon dioxide or nitrogen gas, or a mixture thereof, is typically connected to the supply container in order to maintain the beverage contained within the supply container under pressure. This pressure, in turn, forces the beverage from the supply container through the conduit to the faucet when it is desired to dispense the beverage from the system. Such a dispensing system typically operates at a relatively high pressure, in the range of from about 30 to about 40 psi.

Another type of carbonated beverage dispensing system is a self contained dispensing system. In one type of self contained dispensing system, the beverage is stored within a container and a flexible pressure pouch is immersed within the beverage. The pressure pouch may comprise various compartments housing components of a two-part gas generating system. The pressure pouch may be configured such that, as beverage is dispensed from the system, additional pouch compartments are opened, causing additional chemical components to be mixed. This, in turn, causes the pressure pouch to expand and maintain the pressure within the system. Examples of such self contained dispensing systems, and of pressure pouches used in conjunction therewith, are disclosed in U.S. Pat. No. 4,785,972 to LeFevre; U.S. Pat. No. 4,919,310 to Young et al.; U.S. Pat. No. 4,923,095 to Dorfman et al.; U.S. Pat. No. 5,333,763 to Lane et al.; U.S. Pat. No. 5,769,282 to Lane et al. and U.S. patent application Ser. No. 09/334,737 of Lane et al., filed Jun. 17, 1999, for READILY DEFORMABLE PRESSURE SYSTEM FOR DISPENSING FLUID FROM A CONTAINER, which are all hereby specifically incorporated by reference for all that is disclosed therein.

Some types of beers are commonly charged with nitrogen gas in place of, or in addition to, carbon dioxide gas. Beer that has been charged with nitrogen gas in this manner is commonly referred to as "nitrogenized beer" or, more simply, "nitro beer". In order to properly dispense a nitro beer, it is necessary that the dissolved nitrogen gas be forced out of solution during dispensing, i.e., immediately prior to the time at which the beer is poured into a container or glass to be consumed by a consumer.

Compared to carbon dioxide, nitrogen is relatively difficult to force out of solution. Accordingly, specialized beer taps or faucets may be used for dispensing nitro beers from pressurized dispensing systems. These specialized faucets are specifically designed to agitate the beer in order to force the dissolved nitrogen out of solution. An example of such a specialized faucet for dispensing nitro beer is disclosed, for example, in U.S. patent application Ser. No. 09/362,483 of Whitney et al., filed Jul. 28, 1999, for METHOD AND APPARATUS FOR DISPENSING A LIQUID CONTAINING GAS IN SOLUTION, which is hereby specifically incorporated by reference for all that is disclosed therein.

In conventional (i.e., non nitrogenized) carbonated beverage dispensing systems, however, it is desirable to maintain at least a portion of the carbon dioxide gas in solution to preserve the flavor profile and mouth feel of the beverage. Accordingly, it is desirable to gently reduce the pressure of such a conventional carbonated beverage from the pressure existing within the dispensing system to the ambient atmospheric pressure existing outside of the system. If the pressure is reduced too rapidly, the resulting shock will force a large amount of carbon dioxide out of solution and result in excessive outgassing of carbon dioxide and, thus, an undesirable amount of foaming in the dispensed beverage. Typically, pressure is gently reduced by providing a flow restrictor between the supply of beverage within the system and the exterior of the system. Such a flow restrictor might, for example, comprise a length of tubing through which the beverage is forced to flow. The length and diameter of the tubing are typically chosen so as to provide the proper amount of flow restriction relative to the operating pressure of the dispensing system. Alternatively, such a flow restrictor might take the form of a helical flow path. Examples of flow restrictors for dispensing carbonated beverages are disclosed in U.S. provisional patent application serial No. 60/129,945 of Lane et al., filed Apr. 19, 1999, for METHOD AND APPARATUS FOR DISPENSING A FLUID, which is hereby specifically incorporated by reference for all that is disclosed therein.

The type of flow restrictor described above, however, can be problematic when used in a dispensing system in which the system pressure varies. In the self contained pressure pouch system described above, for example, system pressures may fluctuate significantly, e.g., between about 10 psi and about 25 psi, during operation. This pressure fluctuation is caused by the sequential opening of the pouch compartments and the inability of the two chemical gas generating components to generate gas at a rate that will keep up with the beer dispensing rate. When, for example, a new compartment is opened, additional chemical component will react, eventually causing the pressure to rise. Subsequent dispensing of fluid from the container, on the other hand, will cause the system pressure to decline until another compartment opens.

Such pressure fluctuations make it difficult to select a flow restrictor that functions adequately under all operating conditions. If, for example, a flow restrictor is sized for the average system pressure, then an unacceptably high flow rate (possibly resulting in undesirable foaming) may be experienced when the system is operating toward the higher end of its pressure range. By the same token, an unacceptably low flow rate may be experienced when the system is operating toward the lower end of its pressure range.

Providing a variable flow restrictor for use in conjunction with a fluctuating pressure dispensing system is generally known. This type of variable flow restrictor adjusts the level of flow restriction in response to system pressure in an attempt to maintain a relatively constant dispensing flow rate regardless of system pressure. An example of such a variable flow restrictor for use with a beer dispensing system is disclosed in U.S. Pat. No. 4,210,172 of Fallon et al., which is hereby specifically incorporated by reference for all that is disclosed therein.

This type of variable flow restrictor, however, is relatively expensive and complicated to manufacture. This increased expense and complexity make such variable flow restrictors particularly impractical for use with self contained dispensing systems, which often represent disposable or limited re-use containers.

Accordingly, it would be desirable to provide a dispensing mechanism which provides for the proper dispensing of pressurized beverages and which overcomes the problems discussed above.

SUMMARY OF THE INVENTION

A fluid flow restrictor is disclosed in which the amount of fluid flow restriction increases in response to higher dispensing system pressures and decreases in response to lower dispensing system pressures. In this manner, a relatively consistent flow rate of fluid being dispensed can be maintained regardless of fluctuations in system pressure. Variable resistance is provided by changing the length of the fluid flow path or by changing the cross-sectional area, and, thus, the volume of the fluid flow path, or by changing both the length and the cross-sectional area of the fluid flow path.

In one embodiment, the fluid flow restrictor may include an insert member housed within a valve body. The insert member may include a raised rib which surrounds a plurality of support members. The support members may be longer than the raised rib such that, under very low pressure situations, the raised rib does not contact the valve body. As pressure increases, a progressively longer portion of the raised rib comes into contact with the valve body, thus increasing the length of the fluid flow path. After the entire raised rib is in contact with the valve body, further increase in pressure may cause a central portion of the insert member to deflect, thus causing the cross-sectional area of the fluid flow path to decrease. Thus, the length of the fluid flow path increases and the cross-sectional area of the fluid flow path decreases to compensate for increases in pressure. Conversely, the length of the fluid flow path decreases and the cross-sectional area of the fluid flow path increases to compensate for decreases in pressure.

In another embodiment, the height of the insert member raised rib may be made to decrease in the radially inward direction. In this manner, as pressure increases, a progressively longer portion of the raised rib will come into contact with the valve body, thus increasing the length of the fluid flow path.

In another embodiment, the valve body may be tapered such that the distance between the valve body and the insert member increases in the radially inward direction. As system pressure increases, the insert member is deflected into contact with the tapered portion of the valve body. In this manner, as pressure increases, a progressively longer portion of the raised rib will come into contact with the valve body, thus increasing the length of the fluid flow path.

In a further embodiment, the insert member may be provided with a reduced thickness resilient wall portion such that differential between the system pressure and the pressure of the fluid within the fluid flow path will cause the wall portion to deflect into the fluid flow path. This, in turn, reduces the cross-sectional area of the fluid flow path, and increases the amount of fluid flow restriction. The thickness of the reduced wall portion may be increased in the radially inward direction in order to compensate for increasing pressure differential in this direction.

In another embodiment, an insert member may have a helical rib formed on its outer surface. A resilient member may surround the helical rib such that a fluid flow path is defined between the outer surface of the insert member, the helical rib and the resilient member. In this manner, the differential between the system pressure and the pressure of the fluid within the fluid flow path will cause the resilient member to deflect into the fluid flow path. This, in turn, reduces the cross-sectional area of the fluid flow path, and increases the amount of fluid flow restriction.

DETAILED DESCRIPTION OF THE INVENTION

Figure 1:
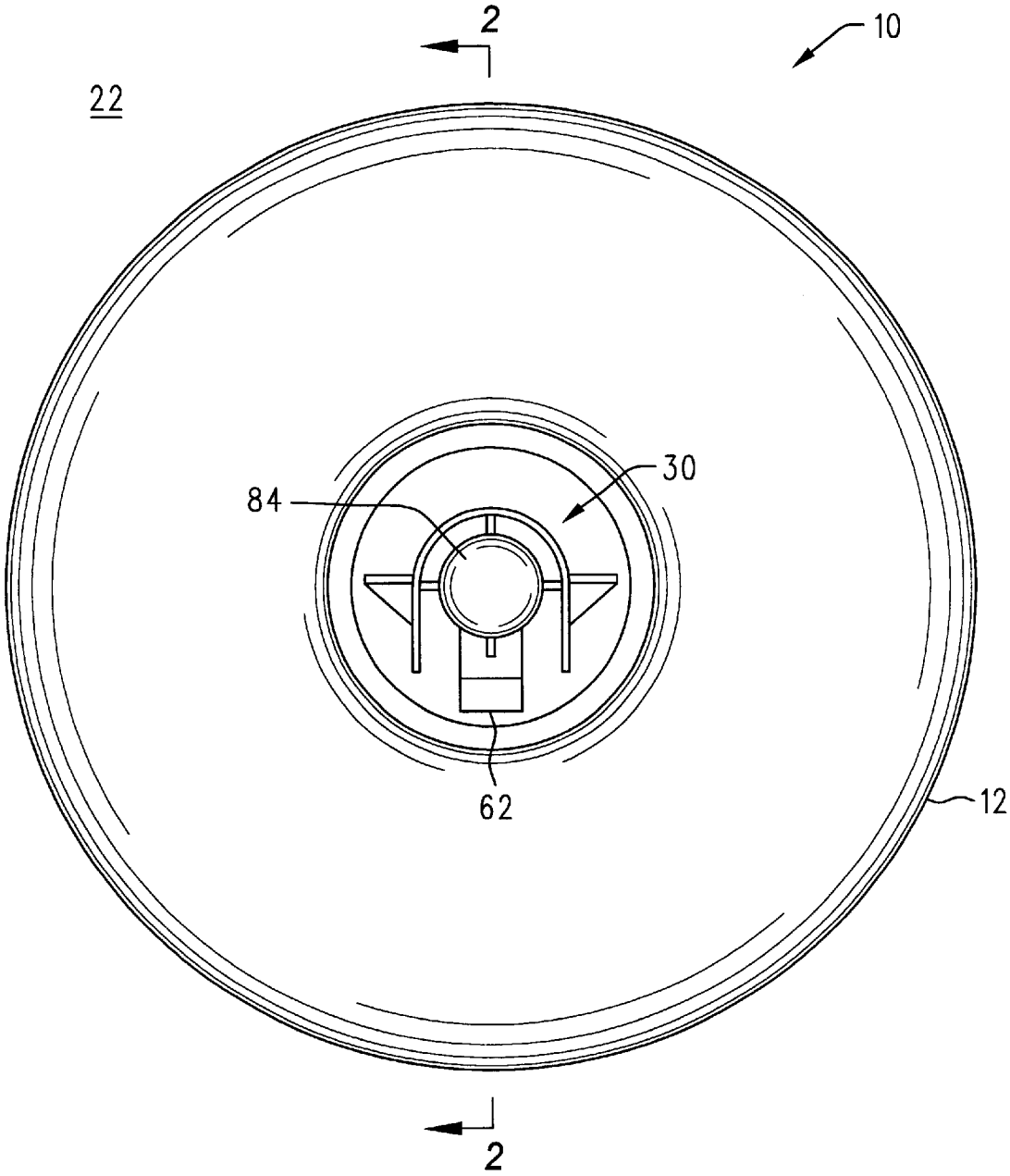
FIG. 1 (PRIOR ART)
FIG. 1 is a front elevational view of a beverage dispensing system including a prior art dispensing valve assembly.

FIGS. 4–14 generally illustrate a dispensing system 10 for dispensing a fluid 16. The dispensing system 10 may include a supply of the fluid and a fluid flow path extending from the supply of the fluid to a point external 22 to the dispensing system 10. The dispensing system 10 may have at least a first condition and a second condition. In the first condition, the supply of the fluid 16 is at a first pressure and the fluid flow path has a first length. In the second condition, the supply of the fluid 16 is at a second pressure and the fluid flow path has a second length. The second pressure is greater than the first pressure and the second length is greater than the first length.

FIGS. 4–14 further illustrate, in general, a method of regulating the flow rate of a fluid 16 from a dispensing system 10. The method may include providing a supply of the fluid 16 and providing a fluid flow path extending from the supply of the fluid 16 to a point external 22 to the dispensing system 10. The fluid flow path has a variable length. The method may further include causing an increase in pressure of the supply of the fluid 16; causing the variable length of the fluid flow path to increase in response to the increase in pressure; and dispensing at least a portion of the fluid 16 from the dispensing system 10 by moving the at least a portion of the fluid 10 from the supply of the fluid 16 to the point external 22 to the dispensing system 10 along the fluid flow path.

FIGS. 4–14 further illustrate, in general a dispensing system 10 including a supply of a liquid 16 containing gas in solution and a flow path extending from the supply of the liquid 16 to a point external 22 to the dispensing system 10. The dispensing system 10 has at least a first condition and a second condition. In the first condition, the supply of the liquid 16 is at a first pressure and the flow path has a first volume. In the second condition, the supply of the liquid 16 is at a second pressure and the flow path has a second volume. The second pressure is greater than the first pressure and the second volume is smaller than the first volume.

Having thus described the apparatus and method in general, they will now be described in further detail.

Figure 2:
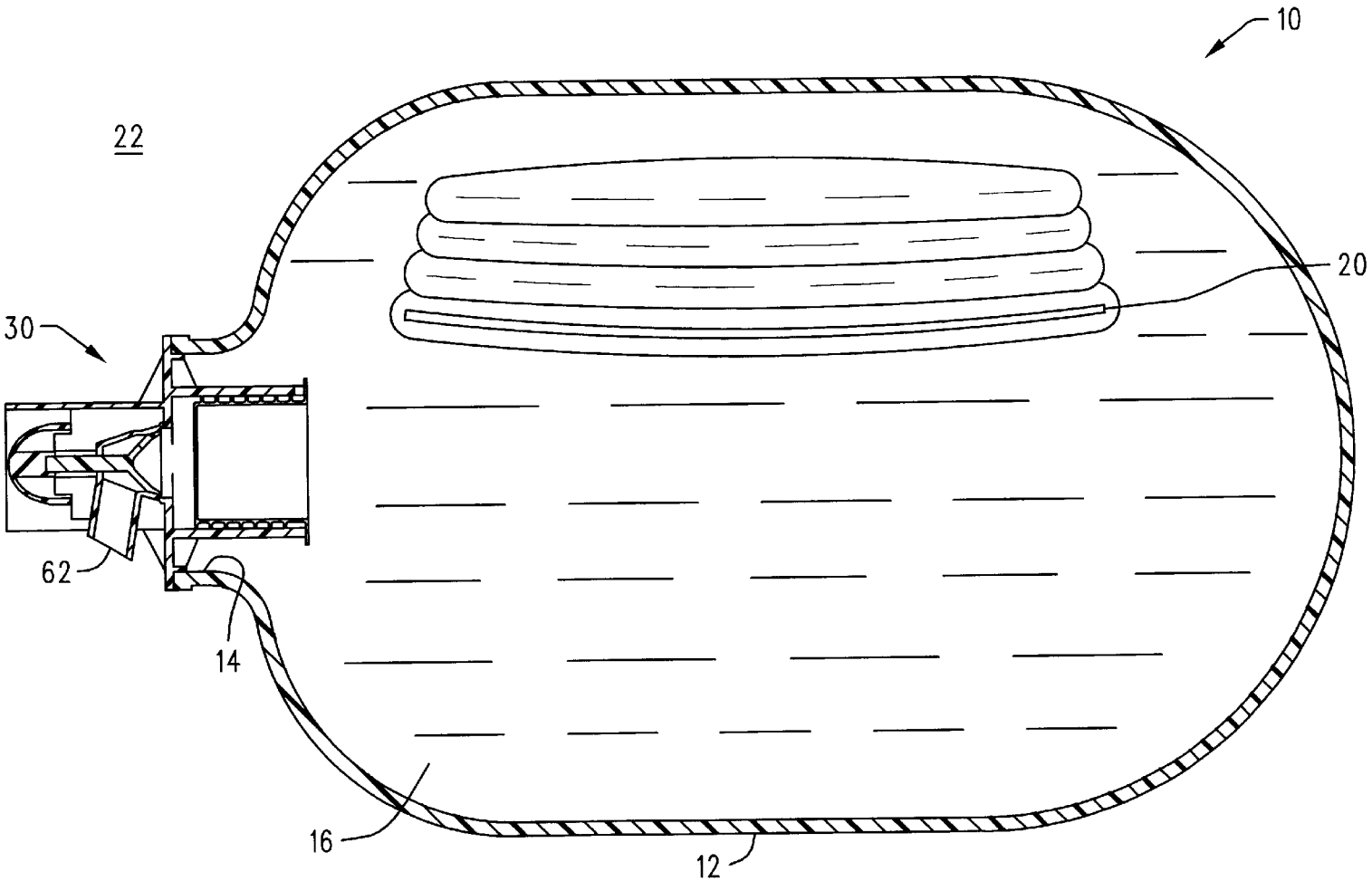
FIG. 2 (PRIOR ART)
FIG. 2 is a cross-sectional elevational view taken along the line 2—2 in FIG. 1.

FIGS. 1 and 2 generally illustrate a beverage dispensing system 10. Beverage dispensing system 10 may include a container 12 having an opening 14, FIG. 2. A dispensing valve assembly 30 may be located within and, thus, seal the opening 14. Dispensing valve assembly 30 may be attached to the container 12 via any conventional mechanism, for example by a conventional crimp ring, not shown. Dispensing valve assembly 30 may include a dispensing opening 62.

Referring to FIG. 2, a liquid 16 may be located within the container 12. The liquid may, for example, be a carbonated beverage such as beer. A pressure pouch 20 may also be located within the container 12 as shown. Pressure pouch 20 may be of the type which contains various compartments housing components of a two-part gas generating system.

In operation, the pressure pouch 20 serves to apply pressure to the liquid 16 located within the container 12. Accordingly, the liquid 16, located within the container 12, is maintained at a pressure higher than that of the atmosphere located on the exterior 22 of the container 12. Thus, a user may activate the dispensing valve assembly 30 to cause a portion of the liquid 16 to be dispensed through the opening 62. As liquid is dispensed from the container 12, the pressure pouch 20 will expand, eventually causing a further compartment or compartments within the pouch 20 to open and thereby mix an additional quantity of reactive component. In this manner, the pouch 20 is able to maintain the interior of the container 12 in a pressurized condition.

The container 12 is an example of a self contained dispensing system as previously described and may, for example, maintain the liquid 16 at a pressure which may vary between about 10 and about 25 psi. The dispensing system 10 may, for example, be configured as described in any of U.S. Pat. Nos. 4,785,972; 4,919,310; 4,923,095; 5,333,763; and 5,769,282 or U.S. patent application Ser. No. 09/334,737, as previously referenced.

Figure 3:
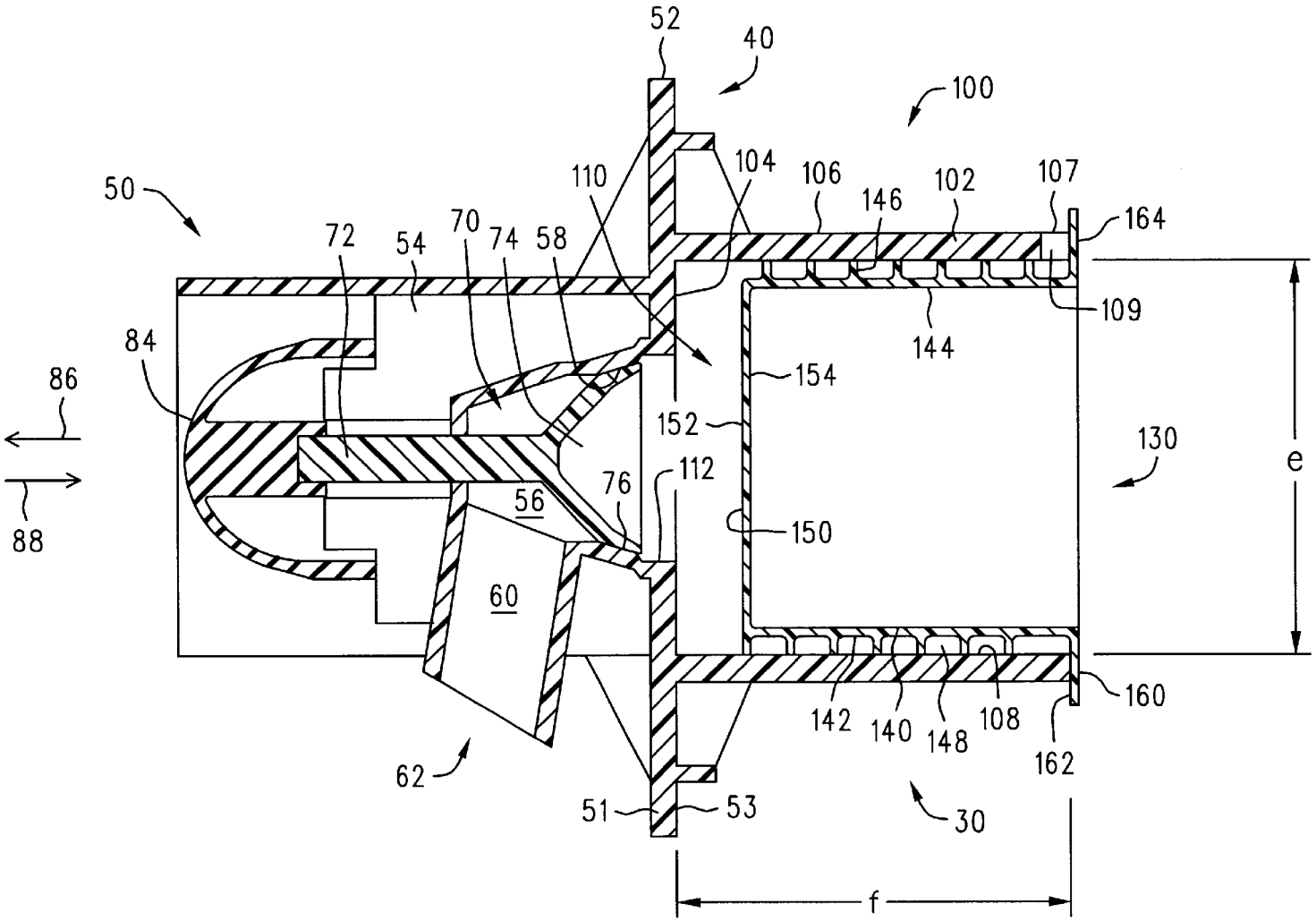
FIG. 3 (PRIOR ART)
FIG. 3 is a cross-sectional elevational view of the dispensing valve assembly of FIG. 2, shown in greater detail.

FIG. 3 illustrates the dispensing valve assembly 30 in further detail. For purposes of the description presented herein, the "front" of the dispensing valve assembly is the end of the assembly proximate the button 84 which extends externally of the container 12 when the assembly is attached to the container in a manner as illustrated in FIGS. 1 and 2. The "rear" of the dispensing valve assembly 30 is the end of the assembly which is proximate the rear surface 164 and which extends into the interior of the container 12 when the assembly is attached to the container. Further, the term "rearwardly" refers to a direction extending toward the rear of the assembly, i.e., the direction 88 in FIG. 3. The term "forwardly" refers to the opposite direction which extends toward the front of the assembly, i.e., the direction 86 in FIG. 3. It is to be understood that the above terms are defined for illustration purposes only. In actual use, the container 12 can be used in various orientations, thus making terms such as "front", "rear", "rearwardly" and "forwardly" relative to the orientation of the container.

Referring to FIG. 3, prior art dispensing valve assembly 30 may include a valve body 40. Valve body 40 generally includes a forward portion 50 and a rear portion 100 as shown. Forward portion 50 may include a circular wall member 51 having a flange portion 52 located at the radially outer edge thereof. A substantially flat rearwardly facing annular surface 53 may be formed on the rearward side of the flange portion 52 as shown. A forwardly projecting portion 54 may extend forwardly from the wall member 51 as shown. A chamber 56 may be enclosed by the forward portion 50. A generally annular tapered valve seat surface 58 may be formed at the rearward end of the chamber 56. The chamber 56 may be in fluid communication with a passage 60. The passage 60 terminates in the opening 62.

A valve member 70 may be located within the valve body forward portion 50 as shown in FIG. 3. Valve member 70 may include a forward stem portion 72 and a flared rearward portion 74. The flared rearward portion 74 may include a generally annular tapered sealing surface 76 which sealingly engages the valve seat surface 58 when the valve assembly 30 is in its closed position, as illustrated in FIG. 3. A resilient button 84 may be attached to the front end of the stem portion 72 such that it exerts a forward force on the valve member 70, i.e., a force in the direction indicated by the arrow 86 in FIG. 3. In this manner, the resilient button 84 biases the valve to its closed position by forcing the valve member tapered sealing surface 76 tightly against the tapered valve seat surface 58.

Valve body rear portion 100 may include an annular wall portion 102 which extends rearwardly from the rear surface 104 of the circular wall member 51. Annular wall portion 102 includes a generally cylindrical outer surface 106, a generally cylindrical inner surface 108 and a generally annular rear surface 109. An opening 107 may be formed through the annular wall portion 102 as shown, extending between the outer surface 106 and the inner surface 108. A chamber 110 is bounded by the annular wall portion inner surface 108 and the circular wall member rear surface 104.

The inner surface 108 of the annular portion 102 may have a diameter "e" of about 1.5 inches as shown in FIG. 3. A distance "f" of about 1.375 inches may extend between the rear portion rear surface 104 and the rear surface 109 of the annular wall portion 102.

Chamber 56 terminates in a generally circular opening 112 formed in the circular wall member rear surface 104, thus establishing liquid communication between the forward portion chamber 56 and the rear portion chamber 110.

Referring again to FIG. 3, an insert member 130 may be housed within the valve body chamber 110. Insert member 130 may include an annular wall portion 140 having a generally cylindrical outer surface 142 and an oppositely disposed generally cylindrical inner surface 144. A helical rib 146 may be integrally formed on the outer surface 142 of the annular wall portion 140 as shown. Insert member 130 may further include a generally circular bottom wall portion 150 integrally formed with the annular wall portion 140. Bottom wall portion 150 may include a forwardly facing surface 152 and a rearwardly facing surface 154. An annular flange 160 may be integrally formed on the insert member 130 opposite the bottom wall portion 150. Flange 160 may include a forwardly facing surface 162 and a rearwardly facing surface 164.

Valve body 40 may, for example, be integrally formed from a plastic material such as polypropylene. Valve member 70 may, for example, be integrally formed from a plastic material such as polyethylene. Insert member 130 may, for example, be integrally formed from a plastic material such as polypropylene. Valve body 40, valve member 70 and insert member 130 may, for example, be formed by any conventional process, such as an injection molding process. Button 84 may, for example, be integrally formed from an elastomeric material such as polyurethane. Button 84 may, for example, be formed by any conventional process, such as an injection molding process.

When the insert member 130 is installed within the chamber 110, as shown in FIG. 3, the insert member flange forwardly facing surface 162 may abut the annular wall portion rear surface 109 as shown. The helical rib 146 of the insert member 130 may also frictionally engage the inner surface 108 of the annular wall portion 102. The insert member 130 may be held in place within the chamber 110 via this frictional engagement between the helical rib 146 and the inner surface 108. As can be appreciated, a generally helical fluid flow passage 148 will be formed between the surfaces 108 and 142 and the adjacent portions of the helical rib 146.

When the dispensing valve assembly 30 is inserted into the opening of a dispensing container (such as the opening 14 in the container 12, FIG. 2), rear surface 53 of the flange portion 52 will abut the container opening. The dispensing valve assembly 30 may then be securely fastened to the container, for example, with a crimp ring in a conventional manner. Fastened in this manner, the rear portion 100 of the valve assembly 30 will be located within the container and, thus, exposed to the pressurized liquid to be dispensed therefrom. The forward portion 50 of the valve assembly 30 will be located on the exterior 22 of the container.

To dispense liquid using the dispensing valve assembly 30, a user depresses the button 84, i.e., in the direction indicated by the arrow 88 in FIG. 3. This movement, in turn, causes the attached valve member 70 to move in the same direction, thus unseating the valve member sealing surface 76 from the valve seat surface 58. When the valve member is moved to its open position in this manner, liquid contained within the container will begin to flow out through the dispensing opening 62 of the dispensing valve assembly 30. Specifically, the pressurized liquid within the container will first pass through the opening 107, thus entering the rearward end of the fluid flow passage 148. Thereafter, the liquid will travel along the helical passage 148 until it exits into the space generally located between the insert member forwardly facing surface 152 and the rear portion rear surface 104. From this space, the fluid will next enter the chamber 56 through the opening 112, passing over the open valve member flared rearward portion 74. From the chamber 56, the fluid will then travel through the passage 60 and exit the system through the opening 62 where it may be dispensed, for example, into a cup or glass for consumption.

The helical passage 148 of the dispensing valve assembly 30 is provided in order to gently reduce the pressure of the liquid from the system pressure existing within the container to the atomospheric pressure existing outside of the container. Such a gentle reduction in pressure is necessary when dispensing highly carbonated beverages in order to prevent excess foaming and outgassing when the beverage is dispensed.

Although the helical passage flow restrictor generally works well, it is not able to compensate for pressure fluctuations within the dispensing system. The amount of restriction supplied by a fixed flow restrictor, such as the helical passage flow restrictor described above, is dictated primarily by the length and the cross-sectional area of the flow restrictor passage. Specifically, increasing the length of the passage tends to increase resistance. Decreasing the cross-sectional area of the passage also tends to increase resistance. A fixed flow restrictor, thus, is generally designed having a length and cross-sectional area selected to provide optimum restriction at one particular system operating pressure. Accordingly, system pressure fluctuations (as encountered, for example, in a self contained dispensing system of the type described above) make it difficult to select a fixed flow restrictor that functions adequately under all operating conditions. If, for example, a fixed flow restrictor is sized for the average system pressure, then an unacceptably high flow rate (possibly resulting in undesirable foaming) may be experienced when the system is operating toward the higher end of its pressure range. By the same token, an unacceptably low flow rate may be experienced when the system is operating toward the lower end of its pressure range.

It would, therefore, be desirable to provide a variable flow restrictor for use with a dispensing system having fluctuating operating pressures. As previously described, however, prior variable flow restrictors are relatively expensive and complicated to manufacture. This increased expense and complexity make such variable flow restrictors particularly impractical for use with self contained dispensing systems, e.g., of the type described above, which often represent disposable or limited re-use containers.

Figure 4:
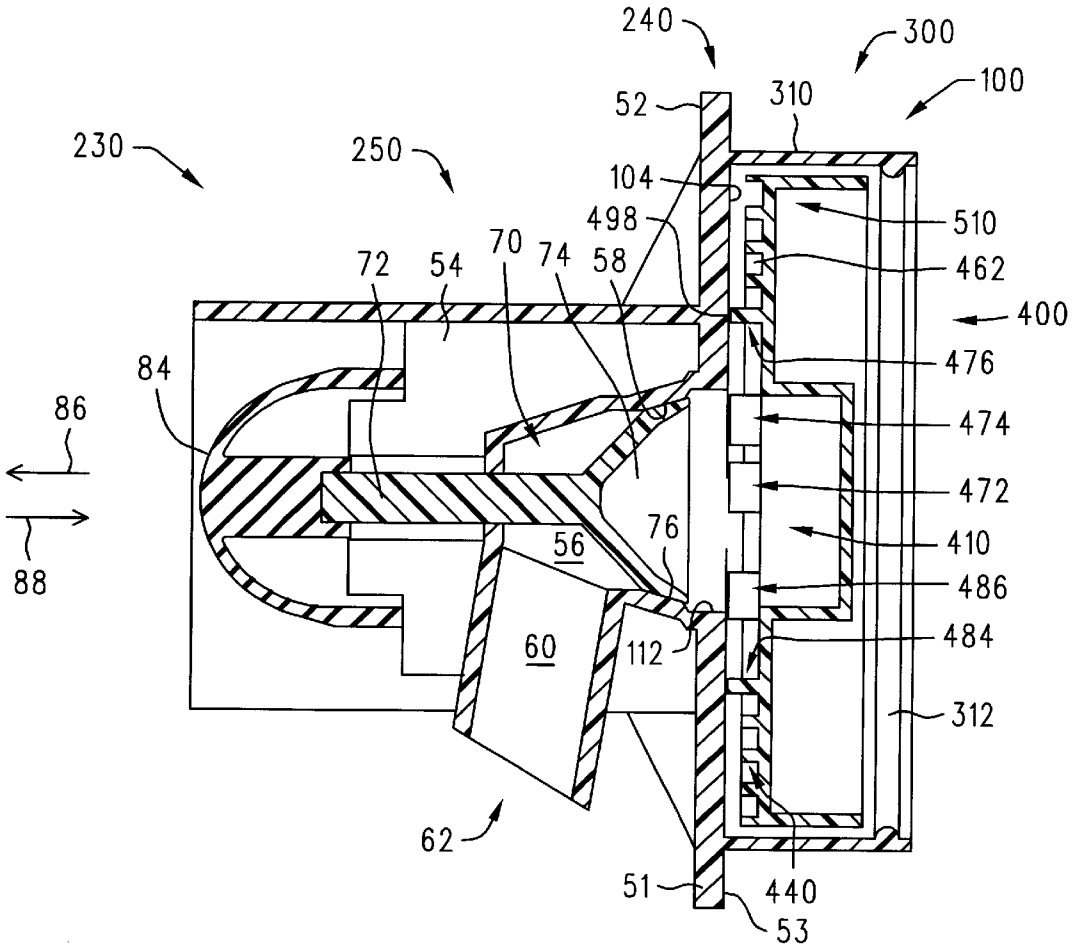
FIG. 4 is a cross sectional elevational view, similar to that of FIG. 3, of an improved dispensing valve assembly and specifically illustrating an improved insert member installed within an improved valve body.

FIG. 4 illustrates an improved dispensing valve assembly 230. The improved dispensing valve assembly 230 may be used in a beverage dispensing system 210, FIG. 7. Except for the substitution of the improved dispensing valve assembly 230 for the previous dispensing valve assembly 30, the beverage dispensing system 210 may be substantially identical to the system 10 previously described with respect to FIGS. 1 and 2. Accordingly, the same reference numerals are used in FIG. 7 to refer to similar features shown in FIGS. 1 and 2. Improved dispensing valve assembly 230 may be attached to the container 12, FIG. 7, in a manner identical to which the dispensing valve assembly 30 is attached to the container 12, as previously described with respect to FIGS. 1 and 2.

Referring again to FIG. 4, the improved dispensing valve assembly 230 may include a flow restrictor insert member 400 which provides variable resistance to compensate for fluctuating dispensing system pressure. Although providing variable resistance, as will be described in further detail herein, the valve assembly 230 is relatively simple and inexpensive to manufacture.

With further reference to FIG. 4, the dispensing valve assembly 230 may include an improved valve body 240 and an improved insert member 400 as discussed generally above. The valve body 240 may include a forward portion 250 and a rear portion 300 as shown. The valve body forward portion 250 may, for example, be identical to the valve body forward portion 50 previously described with respect to FIG. 3. Due to the similarities, the valve body forward portion 250 of FIG. 4 generally includes the same reference numerals used in FIG. 3 to refer to common features.

Although the valve body forward portion 250 may be identical to the valve body forward portion 50, FIG. 3, the valve body rear portion 300 and the insert member 400 are substantially modified, as will now be described in detail. Referring to FIG. 4, valve body rear portion 300 may include an annular wall member 310 as shown. Annular wall member 310 may include a detent bead 312 which may, for example, surround the entire inner periphery of the annular wall member 310. Detent bead 312 may serve to retain the insert member 400 in the rear portion 300 of the valve body 240, as shown.

Figure 5:
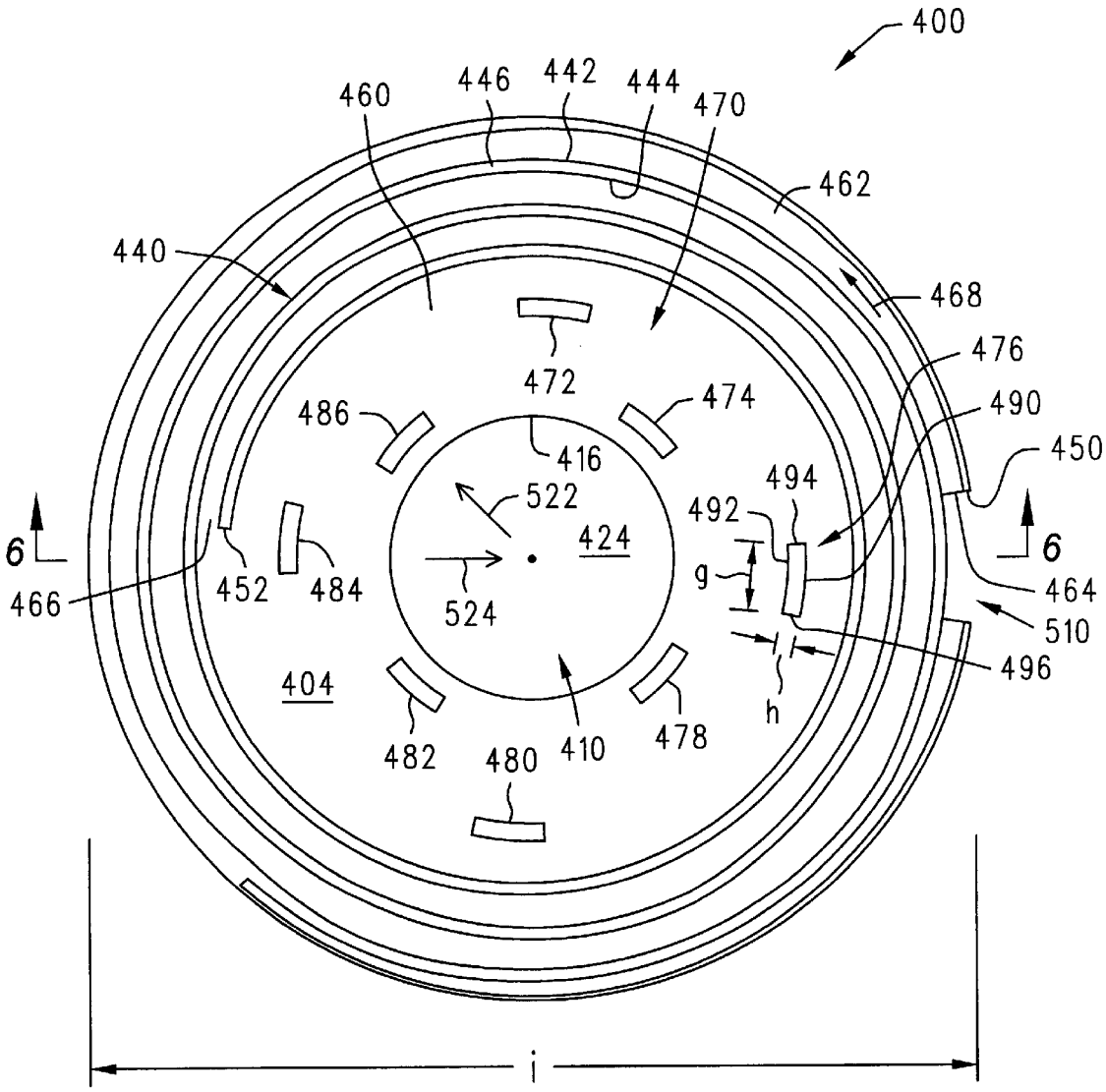
FIG. 5 is a top plan view of the improved insert member of FIG. 4.
Figure 6:
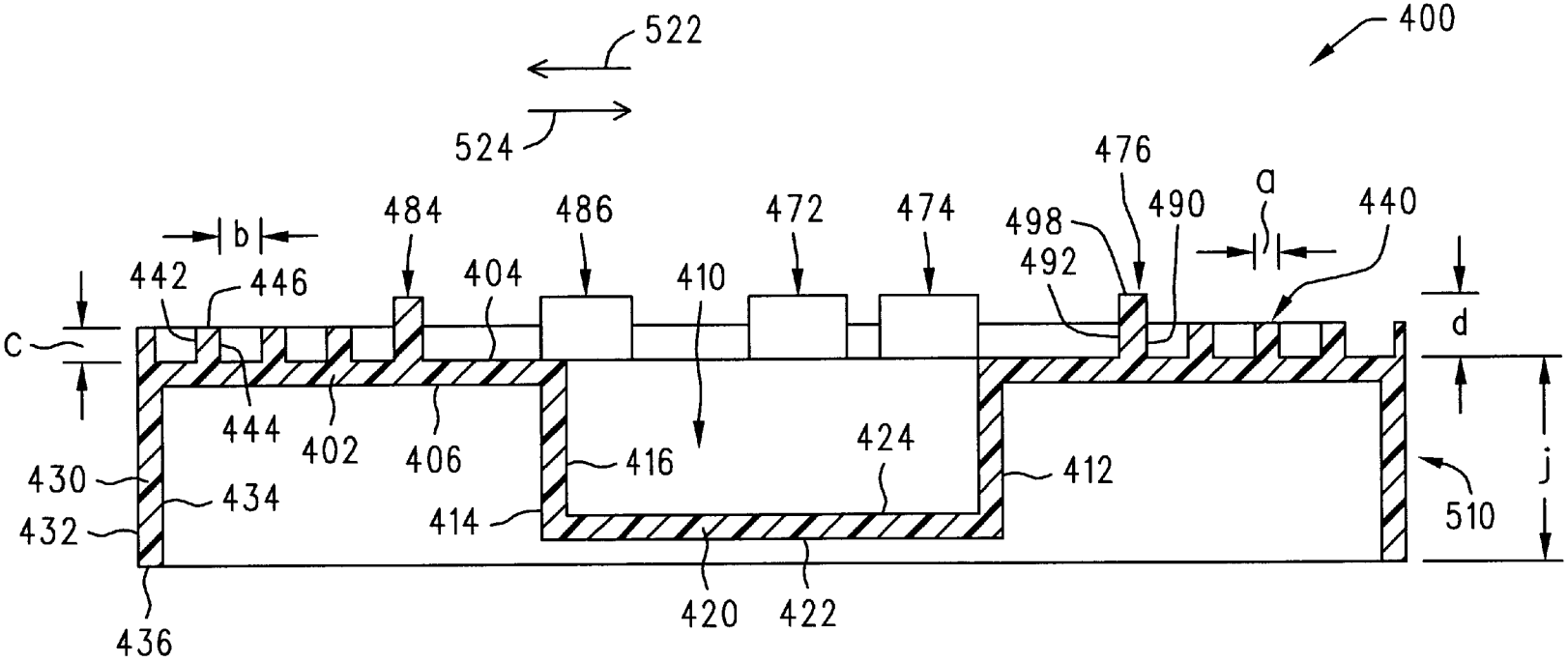
FIG. 6. is a cross-sectional elevational view of the insert member of FIG. 5, taken along the line 6—6 in FIG. 5.

Insert member 400 is illustrated in further detail in FIGS. 5 and 6. Insert member 400 may include a generally annular wall member 402, FIG. 6. Wall member 402 may include a generally annular upper surface 404 and an oppositely disposed generally annular lower surface 406. A well 410 may be centrally formed with respect to the wall member 402, as best shown in FIG. 6. Referring to FIG. 4, well 410 may be provided in order to provide clearance for the rearward portion 74 of the valve member 70 when the valve member moves to its open position.

Referring again to FIG. 6, well 410 may include an annular wall portion 412 which may extend downwardly at substantially a right angle from the wall member 402. Annular wall portion 412 may include a generally cylindrical outer surface 414 and an oppositely disposed generally cylindrical inner surface 416. Well 410 may further include a generally cylindrical wall portion 420 which may extend at a substantially right angle from the annular wall portion 412. Wall portion 420 may include a generally circular outer surface 422 and an oppositely disposed generally circular inner surface 424.

A skirt member 430 may extend downwardly at the outer periphery of the wall member 402, as shown. Skirt member 430 may extend at substantially a right angle from the wall member 402 and may include a generally cylindrical outer surface 432 and an oppositely disposed generally cylindrical inner surface 434. A generally annular surface 436 may join the surfaces 432 and 434 as shown in FIG. 6. Insert member 230 may have an overall diameter "i" FIG. 5. The overall diameter "i" may, for example, be about 2.375 inches.

Referring again to FIGS. 5 and 6, a spiral rib 440 may extend upwardly from the upper surface 404 of the wall member 402. Spiral rib 440 may extend at substantially a right angle relative to the upper surface 404 and may include an outer surface 442 and an oppositely disposed inner surface 444. A surface 446 may extend between the surfaces 442, 446. Spiral rib 440 may, for example, have a substantially uniform thickness "a", FIG. 6. Spiral rib 440 may also be formed having a substantially uniform pitch, causing the space "b" between adjacent portions of the rib to be substantially constant. Spiral rib may extend for a distance "c" from the upper surface 404 of the wall member 402. A distance "j" may extend between the lower surface 436 of the skirt 430 and the upper surface 404 of the wall member 402. The thickness "a" may, for example, be about 0.040 inch. The distance "b" may, for example, be about 0.060 inch. The distance "c" may, for example, be about 0.060 inch. The distance "j" may, for example, be about 0.240 inch. The wall member 402 may, for example, have a thickness of about 0.080 inch extending between the upper surface 404 and the lower surface 406.

Referring to FIG. 5, spiral rib 440 may begin at a radially outer point 450 and end a point 452 which is located radially inwardly relative to the beginning point 450. As can be appreciated from FIG. 5, the spiral rib 440 may extend through a rotational angle of about 900 degrees between the beginning point 450 and the end point 452. In other words, the spiral rib may extend for two and one half complete turns of rotation between the points 450 and 452.

An open area 460 may be located radially inwardly of the spiral rib 440, as best shown in FIG. 5. A plurality of support members 470, such as the individual support members 472, 474, 476, 478, 480, 482, 484, 486, may extend upwardly from the upper surface 404 of the wall member 402 in the open area 460. Each of the support members 470 may extend at substantially a right angle relative to the upper surface 404. Each of the support members 470 may, for example, be substantially identical. Accordingly, only the support member 476 will be described in further detail, it being understood that the remaining support members may be identically formed. Referring to FIGS. 5 and 6, support member 476 may generally be in the form of a parallelogram having a generally rectangular outer surface 490, an oppositely disposed generally rectangular surface 492, a pair of oppositely disposed generally rectangular end surfaces 494, 496 connecting opposite ends of the surfaces 490, 492, and an upper surface 498. Alternatively, support member 476 may have an arcuate shape to facilitate manufacturability of the insert member 400.

Support member 476 may have a length "g", FIG. 5, and a width "h". Support member 476 may extend for a distance "d", FIG. 6, above the upper surface 404 of the wall member 400. This distance "d" may be chosen to be greater than the distance "c" by which the spiral rib 440 extends above the upper surface 440. In this manner, as can be seen in FIG. 6, the support members 470 may extend above the spiral rib 440. The distance "g" may, for example be about 0.190 inch. The distance "h" may, for example, be about 0.060 inch. The distance "d" may, for example, be about 0.080 inch.

In an alternate embodiment, the distance "h" may be increased for all of the support members or for selected support members. This increased thickness "h" may be beneficial in providing increased resistance to system pressure, in a manner that will be described in further detail herein. Referring again to FIG. 5, the distance "h" for the support members 476 and 484 may, for example, be about 0.100 inch while, for the remaining support members, the distance "h" may be as previously specified, i.e. about 0.060 inch.

Referring again to FIG. 5, a notch 510 may be formed in the insert member 400, as shown. Specifically, the notch 510 may comprise a missing section of the skirt 430, FIG. 6. With further reference to FIG. 5, it can be appreciated that the spiral rib 440 defines a spiral flow channel 462. Specifically, the spiral flow channel 462 is defined by the upper surface 404 and the inner and outer surfaces 444, 442, FIG. 6, of adjoining portions of the spiral rib 440. Spiral flow channel 462 may have an entry point 464, where fluid may enter the flow channel 462, and an exit point 466, where fluid may exit the flow channel 462. As can be appreciated, fluid traveling through the spiral flow channel 462 will move in the direction indicated by the arrow 468 in FIG. 5. The spiral flow channel may, for example, have a length of about 16 inches, extending between the entry point 464 and the exit point 466. As will be described in further detail herein, the notch 510 may be provided to facilitate fluid access to the flow channel entry point 464 when the dispensing valve assembly 230, including the insert member 400, is installed within a fluid dispensing system, such as the fluid dispensing system 511, FIG. 7.

Insert member 400 may, for example, be formed from a flexible material, such as polyethylene or ethylene vinyl acetate. Insert member 400 may, for example, be formed via any conventional molding technique, such as injection molding. In this manner, the insert member 400 may be formed as an integral part, i.e., the insert member features described above (e.g., the wall members 402, 412, 420 430, the spiral rib 440 and the support members 470) may all be integrally formed with one another. Alternatively, insert member 400 may be formed using any other conventional forming technique, such as machining.

FIG. 4 shows the insert member 400 installed within the valve body 240 in a substantially non-pressurized condition. Such a non-pressurized condition may exist, for example, before the dispensing valve assembly 230 is installed within the dispensing container 12, FIG. 7. As can be seen from FIG. 4, the upper surfaces of the support members 470, such as the upper surface 498 of the support member 476, are in contact with the rear surface 104 of the valve body 240. As described previously, the height "d", FIG. 6, of the support members 470 is greater than the height "c" of the spiral rib 440. Accordingly, in the non-pressurized condition illustrated in FIG. 4, the contact between the support members 470 and the valve body rear surface 104 prevents the spiral rib 440 from contacting the rear surface 104.

Figure 9:
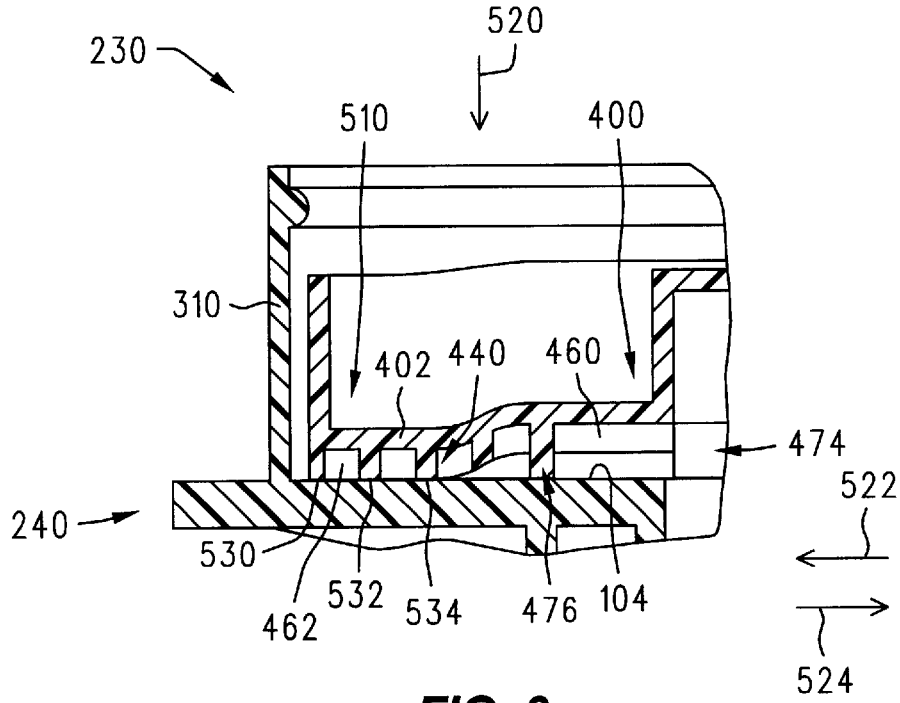
FIG. 9 is a detail cross-sectional view of a portion of the improved dispensing valve assembly of FIG. 4 in a second pressure condition.
Figure 10:
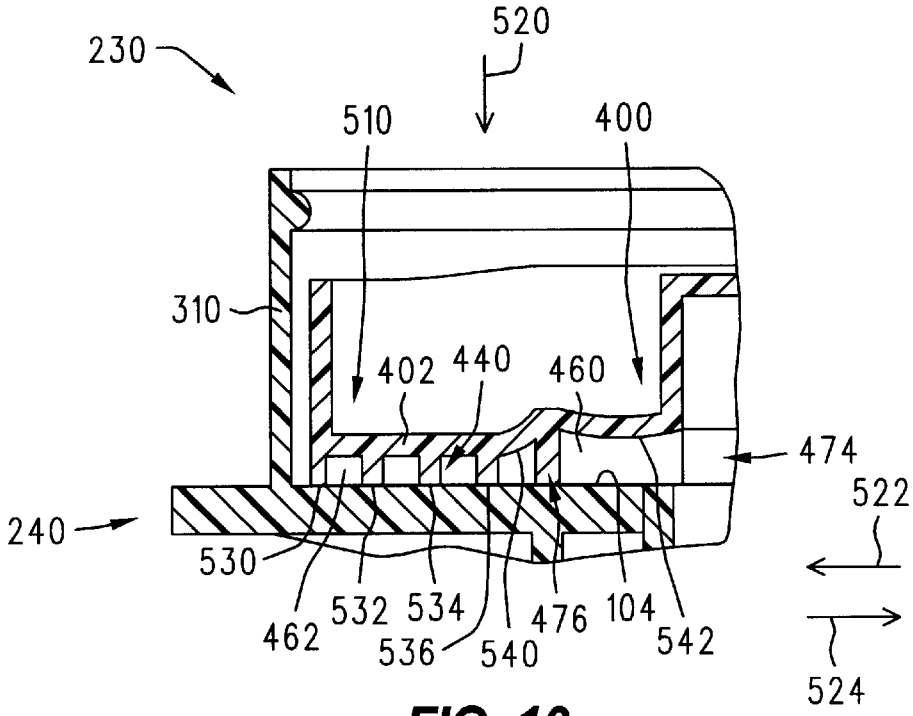
FIG. 10 is a detail cross-sectional view of a portion of the improved dispensing valve assembly of FIG. 4 in a third pressure condition.

As will now be described in further detail, however, when the dispensing valve assembly 230 is installed within a pressurized dispensing system, as illustrated, for example, in FIG. 7, and fluid is dispensed from the system, pressure from the dispensing system will cause the insert member 400 to deflect such that at least a portion of the spiral rib 440 comes into contact with the valve body rear surface 104. As pressure in the dispensing system increases, the insert member will further deflect, causing a further portion of the spiral rib to come into contact with the rear surface 104. Thus, as pressure increases, the length of the spiral flow channel 462 will increase, thus increasing the length of the fluid flow path and increasing the restriction on the flowing fluid. In this manner, the dispensing valve assembly 230 is able to compensate for variable system pressure and, thus, maintain a substantially constant flow rate regardless of system pressure. FIGS. 8–10 schematically illustrate this progressive deflection over a series of increasing pressures.

Figure 7:
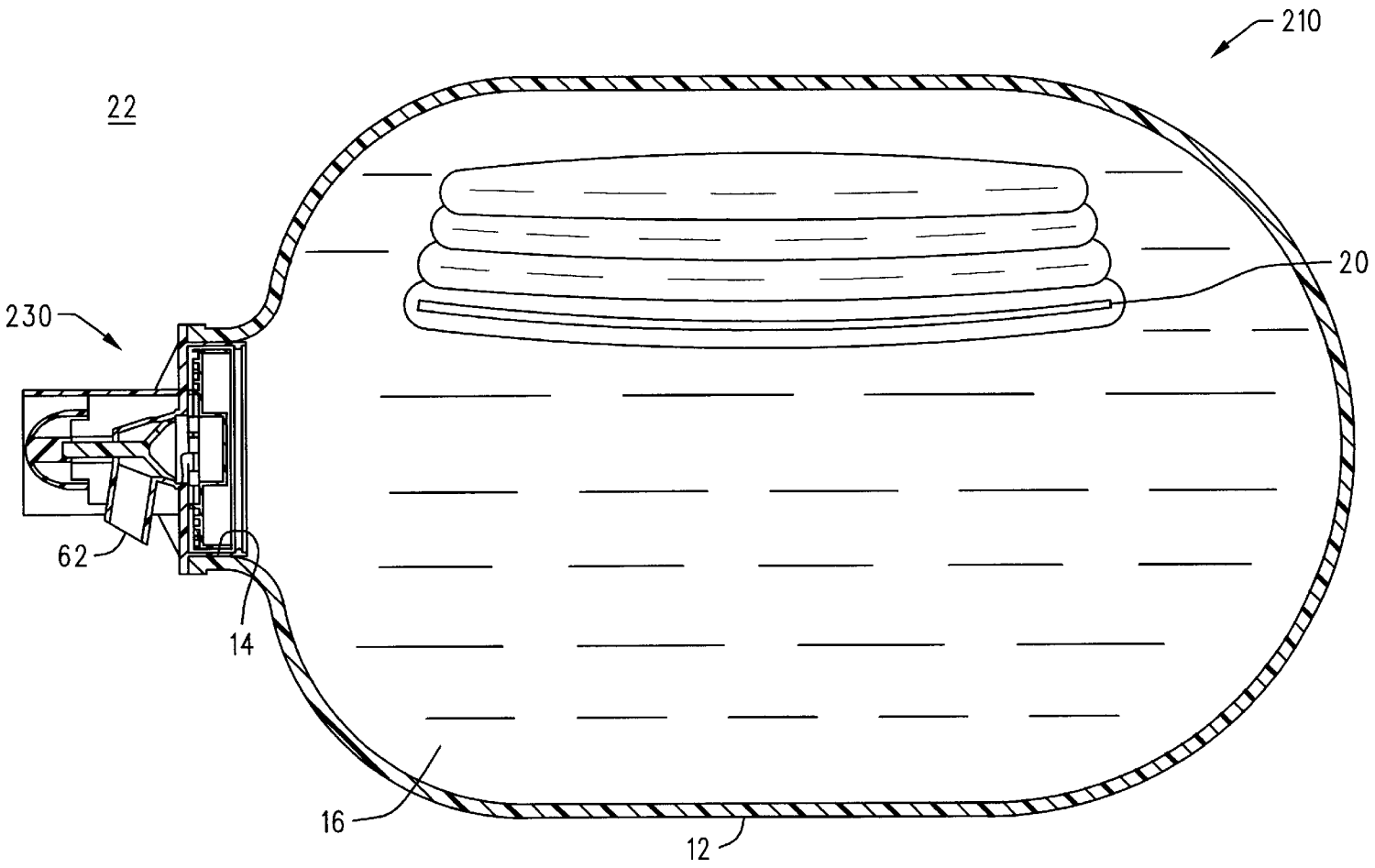
FIG. 7 is a side cross-sectional view, similar to that of FIG. 2, of the improved dispensing valve assembly of FIG. 4 installed within a dispensing system.
Figure 8:
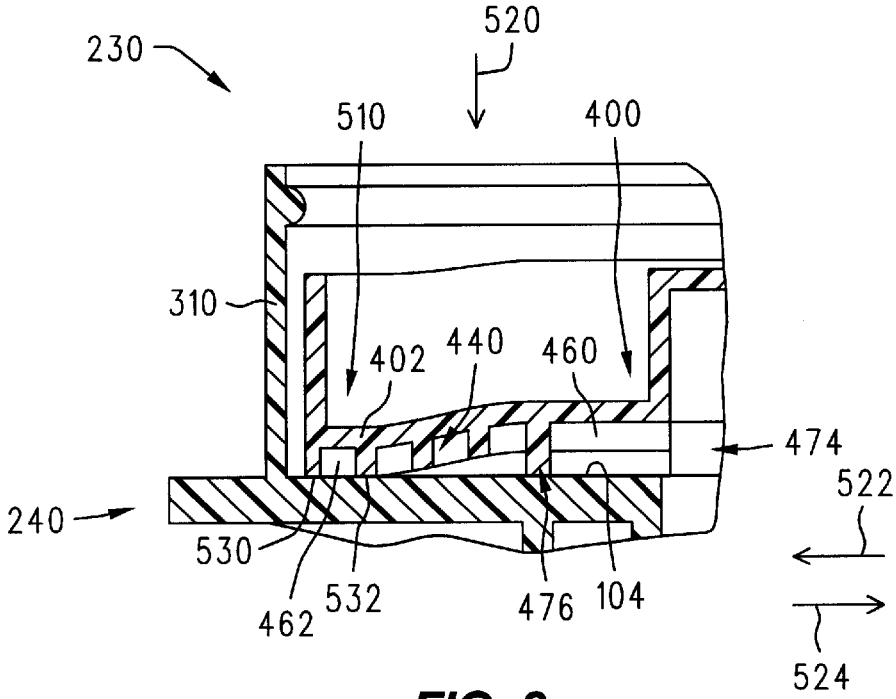
FIG. 8 is a detail cross-sectional view of a portion of the improved dispensing valve assembly of FIG. 4 in a first pressure condition.

FIG. 8 schematically illustrates a portion of the insert member 230 when the dispensing valve assembly 230 is mounted within a dispensing system 210, FIG. 7, and fluid is being dispensed from the system. Referring to FIG. 8, it can be seen that the insert member is partially deflected such that the spiral rib 440 is in contact with the valve body surface 104 at a radially outer (i.e., in the direction of the arrow 522) annular region. The spiral rib 440, for example, is in contact with the surface 104 at the points 530, 532 in FIG. 8. The point 532 represents the radially innermost (i.e., in the direction of arrow 524) point at which contact occurs between the spiral rib 440 and the surface 104. As can be appreciated, in this condition, a spiral flow path is formed beginning at the spiral flow channel entry point 464, FIG. 5 and ending at the point 532, FIG. 8. Specifically, between the points 464 and 532, a spiral flow path will be defined by the spiral flow channel 462 and the surface 104 due to the contact between the spiral rib 440 and the surface 104. At points radially inwardly of the point 532, however, there is no contact between the spiral rib 440 and the surface 104. Accordingly, at points radially inwardly of the point 532, fluid is able to flow beneath the spiral rib 440 (i.e., between the spiral rib 440 and the surface 104), thus bypassing the spiral flow channel 462.

The flow of fluid from the container 12, through the improved dispensing valve assembly 230 will now be described in detail with respect to the condition illustrated in FIG. 8. To dispense liquid using the dispensing valve assembly 230, a user depresses the button 84, i.e., in the direction indicated by the arrow 88 in FIG. 3. This movement, in turn, causes the attached valve member 70 to move in the same direction, thus unseating the valve member sealing surface 76 from the valve seat surface 58. When the valve member is moved to its open position in this manner, liquid contained within the container will begin to flow out through the dispensing opening 62 of the dispensing valve assembly 230.

Specifically, the pressurized liquid 16 within the container 12 will first enter the spiral flow channel 462 through the notch 510. Thereafter, the liquid will travel around the spiral flow passage defined between the points 464, FIG. 5, and 532, FIG. 8. After reaching the point 532, the fluid is free flow in a substantially radial direction and in a relatively unrestricted manner through the open area 460. From this area, the liquid will next enter the chamber 56, FIG. 4, through the opening 112, passing over the open valve member flared rearward portion 74. From the chamber 56, the liquid will then travel through the passage 60 and exit the system through the opening 62 where it may be dispensed, for example, into a cup or glass for consumption.

Referring again to FIG. 8, as can be appreciated, a pressure differential will exist across the wall member 402 when fluid is being dispensed from the system 210. Specifically, the dispensing system pressure, illustrated schematically by the arrow 520, will be greater than the pressure of the fluid flowing within the flow channel 462 due to the restriction provided by the flow channel. This pressure differential is what causes the deflection of the insert member 230 illustrated in FIG. 8 and described above. It is noted that this pressure differential will only exist when fluid is being dispensed from the container 12. When fluid is not being dispensed from the container (e.g., when the valve member 70 is in its closed position), all of the fluid within the system 210 will be at substantially the same pressure. Accordingly, when fluid is not being dispensed from the system, no pressure differential will exist and the insert member will be in the substantially undeflected condition illustrated in FIG. 4.

FIG. 9 is similar to FIG. 8 but illustrates a situation in which the system pressure has increased relative to the condition shown in FIG. 8. This increase in system pressure results in an increase in the pressure differential across the wall member 402 and, thus, an increase in the amount of deflection of the insert member 400. Referring to FIG. 9, it can be seen that the radially inner most contact point between the spiral rib 440 and the surface 104 is now represented by the point 534. Since the point 534 is located radially inwardly of the point 532, the length of the spiral flow path has increased with respect to the relatively lower pressure condition illustrated in FIG. 8. Accordingly, the insert member 400 has reacted to an increase in system pressure by causing the length of the spiral flow path to increase. This increased length of the spiral flow path, in turn, increases the restriction to fluid flow. The improved dispensing assembly 230, thus, functions as a variable flow restrictor in which restriction increases as system pressure increases. This function allows fluid to be dispensed from a variable pressure dispensing system at a relatively constant flow rate. As can be appreciated, however, the improved dispensing assembly 230 and, specifically, the insert member 400, are simple and inexpensive to manufacture relative to conventional variable restrictor devices as previously described.

FIG. 10 is similar to FIGS. 8 and 9 but illustrates a situation when the system pressure has further increased relative to the condition shown in FIG. 9. This increase in system pressure results in a further increase in the pressure differential across the wall member 402 and, thus, increased deflection of the insert member 400. Referring to FIG. 10, it can be seen that the spiral rib 440 is now in contact with the surface 104 at the point 536. Although not visible in FIG. 10, the radially inner most contact point between the spiral rib 440 and the surface 104 is now located at the spiral rib end point 452, FIG. 6. Accordingly, the entire spiral rib is now in contact with the surface 104 and the spiral flow path extends for the entire length of the spiral flow channel 462, i.e., from the entry point 464 to the exit point 466. Thus, in the condition illustrated in FIG. 10, the spiral flow path is at its maximum length and is providing the maximum amount of restriction capable of being supplied by the spiral flow channel.

Even though the spiral flow channel is at its maximum length, in conditions of relatively high pressure, as illustrated in FIG. 10 additional restriction may be provided by the insert member 400 due to deflection of the wall member 400 into the open area 460. Specifically, the wall member 402 may be deflected downwardly, as viewed in FIG. 10, in the areas indicated by the reference numerals 540 and 542. This deflection causes the cross-sectional area of the open area 460 to decrease, thus increasing the restriction to fluid flow.

As described previously, the condition illustrated in FIG. 4 may exist, for example, before the dispensing valve assembly 230 is installed within the dispensing container 12. This condition may also exist, however, after a quantity of the liquid 16 is initially dispensed from the dispensing system 210. This is because dispensing liquid from the system 210 reduces the volume of liquid 16 within the container 12. Because there is a time delay associated with chemical reaction within the pouch 20, the pouch cannot instantaneously expand to compensate for this reduction in volume. Accordingly, when liquid is dispensed from the system 210, the system 210 will experience a pressure drop during the time that it takes the pouch 20 to generate more gas and expand.

After a substantial quantity of the liquid 16 has been dispensed from the system 210, a relatively large gas head space will exist within the pouch 20 and, thus, within the container 12. This relatively large gas head space tends to reduce the amount of system pressure drop that occurs as a result of dispensing as described above. Before any liquid is dispensed from the system 210, however, a very small gas head space exists within the container 12. Accordingly, initial quantities of liquid dispensed from the system (i.e., those quantities dispensed before a substantial quantity of liquid has been dispensed) cause a relatively large pressure drop to occur within the system 210. This pressure drop may, for example, result in the system pressure and, thus, the pressure differential, to drop to as low as about 3 psi.

This relatively low pressure drop, in turn, can sometimes cause the flow rate of liquid being dispensed from the system to become undesirably low. This is particularly true when a fixed resistance flow restrictor, such as that illustrated in FIG. 3, is used. A fixed resistance flow restrictor, since it is designed to operate at a single relatively higher pressure, tends to provide too much flow resistance at a very low pressure.

To combat this problem, dispensing systems, such as the dispensing system 10, FIG. 1, are sometimes filled with a larger initial gas headspace (and, thus, a smaller initial volume of liquid 16). This larger initial headspace tends to reduce the pressure drop induced by dispensing liquid, as described above. Providing a larger initial headspace, however, necessarily means that less liquid 16 can be placed in to the container.

The insert member 400 overcomes this problem by adjusting to provide virtually no fluid flow restriction in very low pressure situations. Specifically, in a very low pressure situation, the insert member 400 will assume the configuration illustrated in FIG. 4. In this configuration, liquid being dispensed from the system 210 can completely bypass the spiral flow channel 462 and the insert member 400 will, thus, provide very little resistance to fluid flow. Accordingly, the insert member 400 allows liquid to be dispensed even in a very low pressure situation. Therefore, the insert member 400 allows the initial headspace to be reduced and, thus, the initial amount of liquid 16 placed in the container 12 to be maximized.

In summary, the insert member 400 is able to provide variable flow restriction to compensate for variable system pressure. At very low pressure, the insert member may provide essentially no resistance to fluid flow. Then as pressure increases, the length of the spiral flow path will increase to provide a longer flow path and, thus, increased restriction. After the spiral flow path reaches its maximum length, further increases in pressure will result in a decreased cross-section area of the open area, thus resulting in a further increase in restriction. In this manner, the improved dispensing valve assembly 230 is able to maintain a fairly constant dispensing flow rate over a range of system pressures.

The insert member 400, constructed according to the exemplary dimensions provided above, has been found to work well in conjunction with the dispensing system described herein over a dispensing system pressure range of from about 3 to about 25 psi. It is noted, however, that the insert member 400 may readily be adapted to work with other types of dispensing systems and other pressure ranges. The restrictive response of the insert 400 to a given pressure differential will be impacted by numerous variables. Increasing the difference between the distances "c" and "d", FIG. 6, for example, will generally make the insert less responsive to changes in pressure. Altering the material from which the insert 400 is constructed will also impact the restrictive response. Specifically, using a stiffer material will generally make the insert less responsive to changes in pressure. Altering the thickness of the material from which the insert 400 is constructed will also impact the restrictive response. Specifically, making the material thicker (e.g., making the wall member 402, FIG. 6, thicker) will make the insert less responsive to changes in pressure. Further, changing the number and location of the support members 470 will impact the restrictive response. Also, the length of the spiral rib 440 (i.e., its rotational extent) may be altered. Specifically, increasing the length of the spiral rib 440 will generally allow the dispensing system to operate over a wider range of pressure differentials while dispensing at acceptable flow rates. Accordingly, the insert member 400 and, thus, the dispensing valve apparatus 230, may readily be adapted to work effectively with a variety of dispensing systems.

It is noted that the improved dispensing valve assembly, including the improved insert 400, have been described in conjunction with a self contained dispensing system for exemplary purposes only. The improved dispensing valve assembly could, alternatively, be used in conjunction with any type of dispensing system where it is desirable to adjust flow restriction to compensate for variable pressure.

The insert member 400 has been described herein as having a circular profile. This profile is preferred since it results in a smooth (i.e. curved) flow path for fluid being dispensed from the system 210. It is noted, however, that the insert 400 could, alternatively, be formed having a profile of virtually any shape. The insert could, for example, have a square or triangular profile, if desired.

It is noted that the dispensing valve assembly 230, as well as the various components thereof, have been described herein in conjunction with a beverage dispensing system for illustration purposes only. The dispensing valve assembly 230 could readily be used in conjunction with any flowable substance where variable flow restriction is necessary or desired. It is further noted that terminology such as "fluid", "liquid" or the like used herein may refer interchangeably to either a pure liquid or to a liquid containing gas in solution (such as a carbonated liquid) or to a pure gas.

Figure 11:
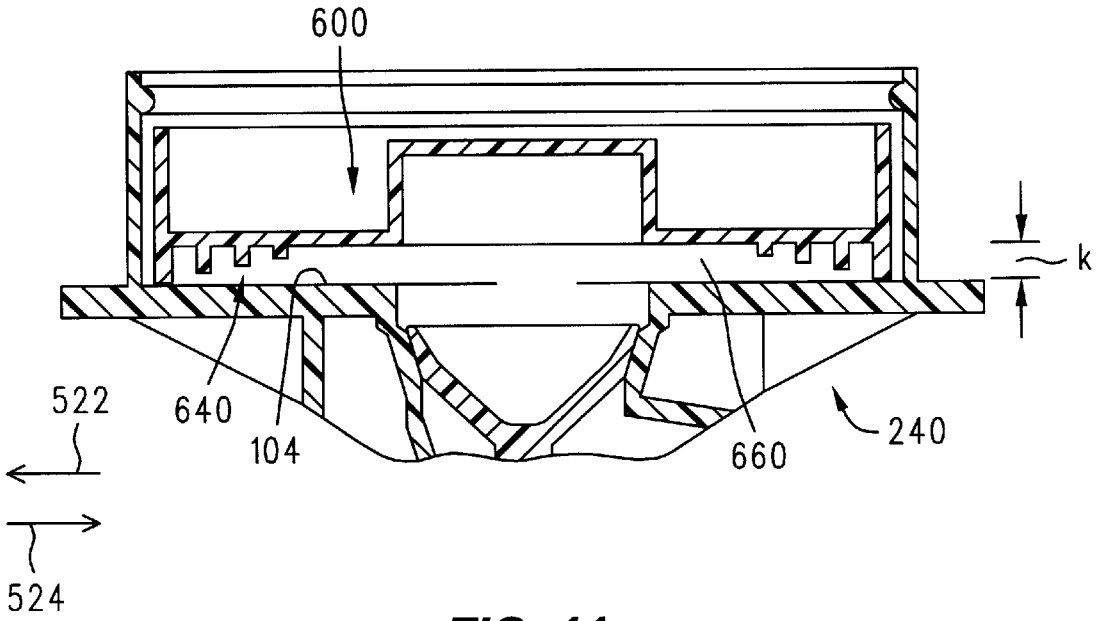
FIG. 11 is a cross-sectional view of another embodiment of an improved dispensing valve.
Figure 12:
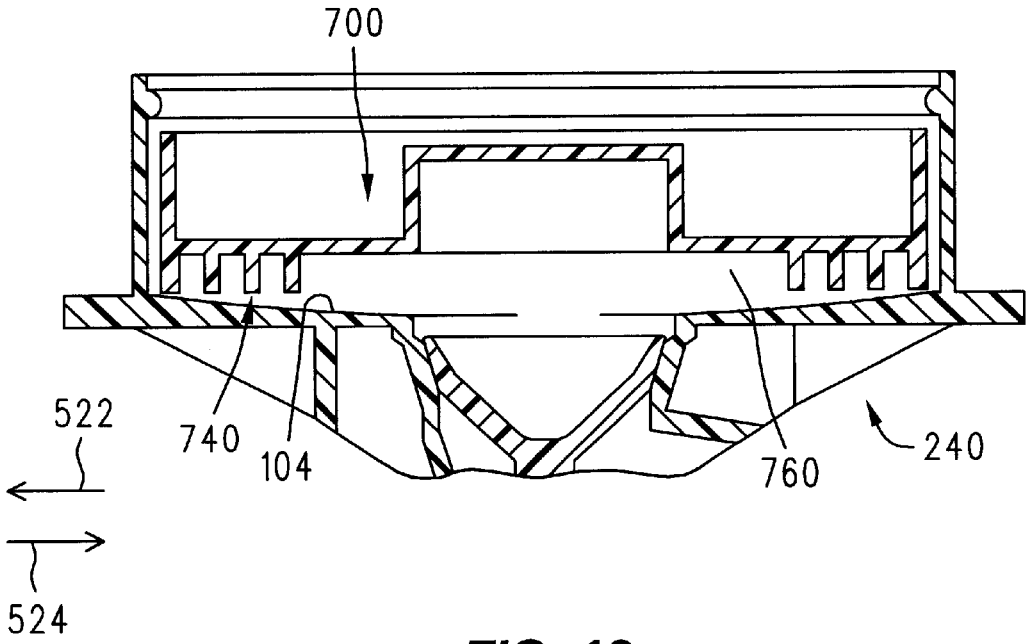
FIG. 12 is a cross-sectional view of a further embodiment of an improved dispensing valve.

FIGS. 11 and 12 illustrate alternative ways to achieve a lengthening of the fluid flow path in response to increased system pressure.

Referring first to FIG. 11, an alternate insert member 600 is illustrated in conjunction with a valve body 240. The valve body 240 may be identical to the valve body 240 previously described. Insert member 600, however, may be formed without support members, such as the support members 470 previously described. Insert member 600 may include a spiral rib 640 in a similar manner to the spiral rib 440, e.g., FIGS. 5 and 6. The height "k", FIG. 11, of the spiral rib 640, however, may decrease in the inwardly radial direction 524. In this manner, increasing system pressure will cause the insert member 600 to increasingly deflect and, thus, cause an increasing length of the spiral rib 640 to come into contact with the surface 104 of the valve body 240. Accordingly, the length of the spiral flow path, and thus the amount of fluid flow restriction, increases as the system pressure increases. After the spiral flow path has reached its maximum length, further increases in system pressure will result in additional deflection of the insert member 600. This additional deflection, in turn, will result in a decrease in the cross sectional area of the open area 660 in a similar manner to that described previously with respect to the open area 460 of the insert member 400. The decrease in cross-sectional area, will result in additional flow restriction as system pressure increases. If desired, support members, such as the support members 470 previously described, may be arranged within the open area 660 to control the amount of decrease in cross-sectional area. Other than the changing height of the spiral rib 640, the insert member 600 may, for example, be substantially identical to the insert member 400 previously described.

In the embodiment of FIG. 12, an alternate insert member 700 is illustrated in conjunction with a valve body 240. The valve body 240 may be identical to the valve body 240 previously described except that the surface 104 may be curved, as illustrated in FIG. 12. Insert member 700 may be substantially identical to the insert member 400 previously described. Insert member 700 may, however, be formed without support members, such as the support members 470, previously described. Insert member 700 may include a spiral rib 740 structured in a substantially similar manner to the spiral rib 440, e.g., FIGS. 5 and 6. As can be appreciated, increasing system pressure will cause the insert member 700 to increasingly deflect and, thus, cause an increasing length of the spiral rib 740 to come into contact with the curved surface 104 of the valve body 240. Accordingly, the length of the spiral flow path, and thus the amount of fluid flow restriction, increases as the system pressure increases. After the spiral flow path has reached its maximum length, further increases in system pressure will result in additional deflection of the insert member 700. This additional deflection, in turn, will result in a decrease in the cross sectional area of the open area 760 in a similar manner to that described previously with respect to the open area 460. The decrease in cross-sectional area, will result in additional flow restriction as system pressure increases. If desired, support members, such as the support members 470 previously described, may be arranged within the open area 760 to control the amount of decrease in cross-sectional area. Other than the possible absence of support members, the insert member 700 may be substantially identical to the insert member 400 previously described.

It is noted that as a further alternative to the embodiment shown in FIG. 12, the spiral flow path could be formed into the curved surface 104 of the valve body 240 and the insert member 700 could be formed without a spiral rib. This alternative would function in substantially the same manner as that described above with respect to FIG. 12, except that the spiral flow path would be formed in the valve body 240, rather than in the insert member 700.

Figure 13:
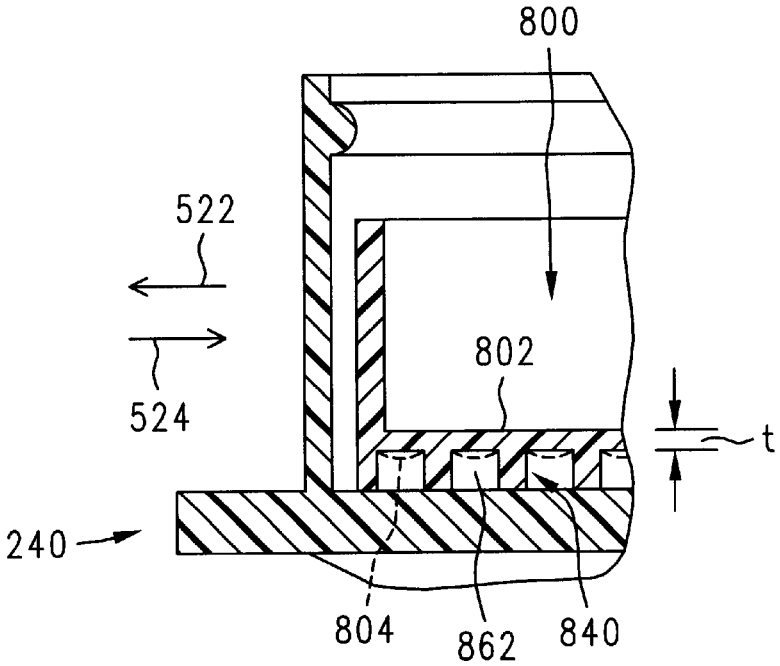
FIG. 13 is a cross-sectional view of a further embodiment of an improved dispensing valve.
Figure 14:
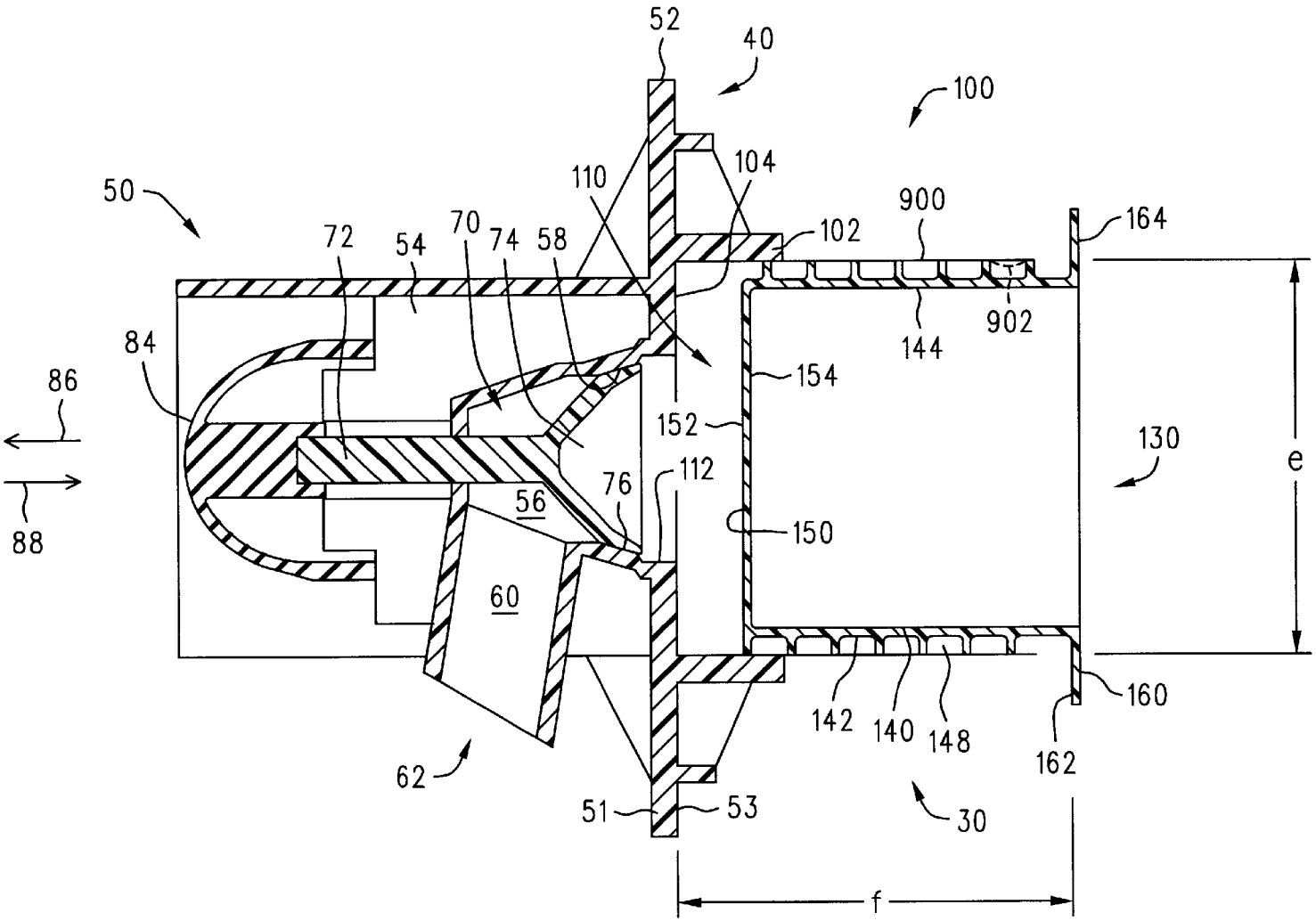
FIG. 14 is a cross-sectional view of a further embodiment of an improved dispensing valve.

FIGS. 13 and 14 illustrate alternative ways to achieve a decrease in cross sectional area of the flow path in response to increased system pressure. As can be appreciated, such a decrease in cross-sectional area will result in increased fluid flow restriction.

Referring to FIG. 13, an insert member 800 is illustrated. The insert member 800 may include a spiral flow channel 862 defined by a spiral rib 840 in a manner similar to the insert member 400 previously described. Insert member 400, however, may include a wall member 802 having a reduced thickness "t" relative to the wall member 402 previously described. This reduced thickness "t" allows the wall member 802 to deflect downwardly in response to system pressure, as indicated by the dashed lines 804. As can be appreciated, this deflection results in a reduced cross-sectional area of the flow channel 862 and, thus, causes increased fluid flow restriction. As can further be appreciated, as the dispensing system pressure increases, the amount of deflection of the wall member 802 will increase, thus causing the amount of fluid flow restriction to vary in response to system pressure. The thickness "t" may, for example, be about 0.010 inch. The insert member 800 may, for example, be formed from ethylene vinyl acetate. Other than the thickness "t" of the wall member 802, the insert member 800 may be formed in a substantially identical manner to the insert member 400. Alternatively, the reduced cross-sectional area effect illustrated in FIG. 13 may be used in conjunction with any other type of insert member disclosed herein in order to increase the amount of fluid flow restriction provided.

With further reference to FIG. 13, as can be appreciated, when fluid is being dispensed from the system, and thus flowing through the spiral flow channel 862, fluid pressure within the spiral flow channel will decrease in the radially inward direction 524. This is due to the fluid flow restriction provided by the flow channel 862. Accordingly, the pressure differential across the wall member 802 (which is the difference between the system pressure and the pressure in the flow channel 862) will increase in the radially inward direction 524. This increase in pressure differential will cause radially inner portions of the wall member 802 to deflect more than radially outer portions. To compensate for this effect, the wall member 802 may be provided with a tapered profile. In other words, the wall member 802 may be formed such that the thickness "t" increases in the radially inward direction 524.

FIG. 14 illustrates a further embodiment in which an insert member 130 is provided housed within the rear portion 100 of a valve body 30. Insert member 130 may, for example, be identical to the insert member 130 previously described with respect to FIG. 3. Valve body 30 may, for example, be identical to the valve body 30 previous described with respect to FIG. 3 except that the wall portion 102 may be shortened as shown. A resilient membrane 900 may be placed over the exposed portion of the helical rib 146. Accordingly, a generally helical fluid flow passage 148 will be formed between the resilient membrane 900, the helical rib 146 and the surface 142 of the insert member 130.

As can be appreciated, in operation, the resilient membrane 900 will deflect into the fluid flow passage 148, as indicated by the dashed line 902. This deflection, in turn, provides variable fluid flow restriction in a similar manner as described above with respect to FIG. 13. Accordingly, the use of a resilient membrane as illustrated in FIG. 14 allows a fixed fluid flow restrictor (such as illustrated in FIG. 3) to function as a variable fluid flow restrictor where the amount of fluid flow restriction is dependent upon system pressure. Resilient membrane 900 may, for example, be formed from silicone rubber, neoprene or urethane having a thickness of between about 0.002 and about 0.007 inch.

While an illustrative and presently preferred embodiment of the invention has been described in detail herein, it is to be understood that the inventive concepts may be otherwise variously embodied and employed and are intended to be construed to include such variations except insofar as limited by the prior art.

What is claimed is:

1. A dispensing system for dispensing a fluid, said dispensing system comprising:

a) a supply of said fluid;

b) a fluid flow path extending from said supply of said fluid to a point external to said dispensing system;

c) wherein said dispensing system has at least a first condition and a second condition;

d) wherein, in said first condition, said supply of said fluid is at a first pressure and said fluid flow path has a first length;

e) wherein, in said second condition, said supply of said fluid is at a second pressure and said fluid flow path has a second length;

f) wherein said second pressure is different from said first pressure and said second length is different from said first length; and g) wherein said fluid is a liquid.

2. The dispensing system of claim 1 wherein said second pressure is greater than said first pressure and said second length is greater than said first length.

3. The dispensing system of claim 2 wherein increase in pressure from said first pressure to said second pressure directly causes said fluid flow path first length to extend to said fluid flow path second length.

4. The dispensing system of claim 1 wherein said second pressure is lower than said first pressure and said second length is less than said first length.

5. The dispensing system of claim 1 wherein said liquid has a gas dissolved therein.

6. The dispensing system of claim 1 wherein said liquid is beer.

7. The dispensing system of claim 1 wherein at least a portion of said fluid flow path has a spiral configuration.

8. The dispensing system of claim 1 wherein:

in said first condition, a portion of said fluid flow path has a first cross-sectional area; and in said second condition, said portion of said fluid flow path has a second cross-sectional area which is smaller than said first cross-sectional area.

9. The dispensing system of claim 1 and further comprising:

a pressure pouch in contact with said supply of fluid.

10. The dispensing system of claim 9 wherein said pressure pouch contains components of an at least two-component gas generating system.

11. A method of regulating the flow rate of a fluid from a dispensing system, said method comprising:

a) providing a supply of said fluid;

b) providing a fluid flow path extending from said supply of said fluid to a point external to said dispensing system, wherein said fluid flow path has a variable length;

c) causing a change in pressure of said supply of said fluid;

d) causing said variable length of said fluid flow path to change automatically in response to said change in pressure; and e) dispensing at least a portion of said fluid from said dispensing system by moving said at least a portion of said fluid from said supply of said fluid to said point external to said dispensing system along said fluid flow path.

12. The method of claim 11 wherein:

said causing a change in pressure of said supply of said fluid comprises causing an increase in pressure of said supply of fluid; and said causing said variable length of said fluid flow path to change comprises causing said variable length of said fluid flow path to increase in response to said increase in pressures.

13. The method of claim 11 wherein:

said causing a change in pressure of said supply of said fluid comprises causing a decrease in pressure of said supply of fluid; and said causing said variable length of said fluid flow path to change comprises causing said variable length of said fluid flow path to decrease in response to said decrease in pressure.

14. The method of claim 11 wherein said fluid is a liquid.

15. The method of claim 11 wherein said fluid is a liquid having a gas dissolved therein.

16. The method of claim 11 wherein said fluid is beer.

17. The method of claim 11 wherein at least a portion of said fluid flow path has a spiral configuration.

18. The method of claim 11:

wherein a portion of said fluid flow path has a cross-sectional area; and causing said cross-sectional area of said portion of said fluid flow path to decrease in response to said increase in pressure.

19. The method of claim 18 and further including:

causing a decrease in pressure of said supply of fluid; and causing said cross-sectional area of said portion of said fluid flow path to increase in response to said decrease in pressure.

20. The method of claim 11 and further including:

providing a pressure pouch in contact with said supply of fluid.

21. The method of claim 20 wherein said pressure pouch contains components of an at least two-component gas generating system.

22. A dispensing system comprising:

a) a supply of a liquid containing gas in solution;

b) a flow path extending from said supply of said liquid to a point external to said dispensing system;

c) wherein said dispensing system has at least a first condition and a second condition;

d) wherein, in said first condition, said supply of said liquid is at a first pressure and said flow path has a first volume;

e) wherein, in said second condition, said supply of said liquid is at a second pressure and said flow path has a second volume; and f) wherein said second pressure is different than said first pressure and said second volume is different than said first volume.

23. The dispensing system of claim 22 wherein said second pressure is greater than said first pressure and said second volume is smaller than said first volume.

24. The dispensing system of claim 23 wherein increase in pressure from said first pressure to said second pressure directly causes said fluid flow path first volume to be reduced to said fluid flow path second volume.

25. The dispensing system of claim 22 wherein said second pressure is less than said first pressure and said second volume is larger than said first volume.

26. The dispensing system of claim 22 wherein said liquid is beer.

27. The dispensing system of claim 22 wherein at least a portion of said flow path has a spiral configuration.

28. The dispensing system of claim 22 and further comprising:

a pressure pouch in contact with said supply of said liquid.

29. The dispensing system of claim 28 wherein said pressure pouch contains components of an at least two-component gas generating system.

* * * * *